United States Patent [19]

Reneau et al.

[11] Patent Number: 4,854,927

[45] Date of Patent: Aug. 8, 1989

[54] METHOD AND APPARATUS FOR PRESSING PERFORATED WEB FED MATERIALS

[75] Inventors: Bobby L. Reneau, Plano; George Rhea, Arlington; Gary Owens, Lewisville, all of Tex.

[73] Assignee: Advanced Graphic Technologies, Inc., Grapevine, Tex.

[21] Appl. No.: 58,521

[22] Filed: Jun. 5, 1987

[51] Int. Cl.[4] ..... B65H 35/00; B31F 7/00

[52] U.S. Cl. ..... 493/27; 493/12; 493/324; 493/352; 493/363; 493/364

[58] Field of Search ..... 493/12, 27, 320, 321, 493/324, 352, 356, 357, 363, 364, 365, 395, 406, 407, 416, 464

[56] References Cited

U.S. PATENT DOCUMENTS

| | | | |
|---|---|---|---|
| 582,311 | 5/1897 | Parnaland . | |
| 995,868 | 6/1911 | Housan | 83/305 |
| 1,123,689 | 1/1915 | Condon . | |
| 1,455,367 | 5/1923 | Uhlemann . | |
| 1,561,060 | 11/1925 | De Vault . | |
| 1,764,939 | 6/1930 | Dina . | |
| 1,983,586 | 12/1934 | Watson et al. | 197/133 |
| 2,008,313 | 6/1935 | Presby | 93/84 |
| 2,047,472 | 7/1936 | Hotchkiss | 493/365 |
| 2,101,753 | 12/1937 | Rambold | 493/363 |
| 2,110,875 | 3/1938 | Holman . | |
| 2,201,481 | 5/1940 | Dollahite | 493/363 |
| 2,229,100 | 1/1941 | Laspley | 290/46 |
| 2,801,501 | 8/1957 | Marogg | 493/363 |
| 3,021,732 | 2/1962 | Schur | 76/101 |
| 3,152,501 | 10/1964 | Nassar | 493/363 |
| 3,454,451 | 7/1969 | Buckholz | 493/364 |
| 3,546,742 | 12/1970 | Kugler | 18/10 |
| 3,760,671 | 9/1973 | Jenkins | 83/155 |
| 3,765,586 | 10/1973 | Floden | 226/84 |
| 3,972,460 | 8/1976 | Kesinger et al. | 226/6 |
| 4,000,803 | 1/1977 | Warp et al. | 197/133 |
| 4,062,021 | 12/1977 | Taylor | 346/136 |
| 4,131,272 | 12/1978 | Hartnig | 493/352 |
| 4,608,037 | 8/1986 | Fleming | 493/22 |

FOREIGN PATENT DOCUMENTS

| | | | |
|---|---|---|---|
| 2103810 | 2/1983 | United Kingdom | 493/27 |

*Primary Examiner*—Frederick R. Schmidt
*Assistant Examiner*—William E. Terrell
*Attorney, Agent, or Firm*—Michael Piontek

[57] ABSTRACT

A method and apparatus is disclosed for flattening perforated web fed materials so that when cut into sheets they stack easily without a tendency to fall to one side. The method and apparatus is particularly adapted to be installed on a web fed printing press equipped for forming perforations in the printed web, the apparatus being located between the perforating and sheeting and stacking stations of the press.

11 Claims, 1 Drawing Sheet

METHOD AND APPARATUS FOR PRESSING PERFORATED WEB FED MATERIALS

DISCLOSURE

This invention relates to a method and apparatus for pressing and/or flattening perforations formed in web stock, and in particular to a method and apparatus for pressing and/or flattening perforations formed on a web printing press equipped with a perforator and sheeter-stacker.

BACKGROUND OF THE INVENTION

Machines for handling sheet material, such as paper, commonly start out as a continuous web of material; an example is a printing press which although it may eventually produce printed sheets, may start out from roll or web stock fed into the press. Printing presses and similar machines may perform a multitude of operations on the continuous web of material, other than printing, such as slitting, punching, folding, and stacking sheets of the printed material. In addition, many paper products, such as advertising fliers, include perforations around coupons or other segments designed to be intentionally detached by the reader from the sheet, and to so such work many presses can be fitted with devices to perforate the sheet adjacent such coupon etc.

In the process of perforating sheet material, small holes and/or slits are actually punched through or formed in the material, leaving a small ridge or bump along the line of perforations. This ridge or bump is formed, to a large extent, by bits of the perforated material which remain attached to the sheet after the perforation process.

On a single sheet of perforated material, the ridge or bump formed along the perforation line is insignificant. However, in most operations, the continuous web of perforated material is subsequently cut into individual sheets and, then, numerous sheets are stacked vertically in a device at the end of the press called a sheeter-stacker. In a stack of hundreds or thousands of individual sheets the effect of the individual small ridges is multiplied to the extent that the stack becomes deformed away from the side the perforation is on and difficult or impossible to handle. Therefore, during operation of an automatic press, the number of sheets of perforated material in a stack must be limited and/or the stack must be adjusted periodically by hand to compensate for the stack-deforming perforation line. As a result, the production output of the press, measured in cutoffs (i.e., individual sheets) per hour, must be reduced significantly below the capabilities of the press operating in a fully automatic mode. In fact, a 40% to 60% reduction in press output is not unusual when running a perforation operation. Furthermore, deformed stacks of perforated sheets cause handling problems during subsequent operations, such as feeding individual sheets from the stack for cutting, folding, or in subsequent bindery operations.

All of the handling problems caused by the ridges or bumps formed on perforated sheets result in lower press production speed (cutoffs per hour), more frequent paper jams, decreased bindery production, more manual handling, and greatly increased production cost per unit of output. Therefore, there is a great need for a simple, effective, and efficient method and apparatus to permit perforated sheets to be placed in high stacks, transported, and manipulated by automatic equipment at high rates of speed, without the need for slow downs and/or special manual handling.

SUMMARY OF THE INVENTION

The present invention comprises a method and apparatus for applying pressure to flatten previously perforated materials. In accordance with the present invention, a presser roller is provided for applying pressure directly to a continuous web of perforated material traveling through a web printing press carrying out a perforating operation. With the perforation flattened, the foregoing disadvantages are eliminated.

The apparatus of the present invention includes means for mounting the apparatus to the press in the form of a pivotable bracket assembly attached to the frame of the press. An elongated cylindrical presser roller, which may extend the width of the web, is mounted on the bracket assembly. A means for loading the presser roller against the web, in the form of a pneumatic cylinder, is provided in this instance, by pivoting the bracket assembly about a pivot point on the frame. Actuating the pneumatic cylinder pivots the mounting bracket so that the presser roller applies a predetermined and desired amount of pressure to the web of perforated material as it passes between the presser roller and a rotating cylinder of the press to accomplish the desired flattening action. An adjustable stop block is provided to limit the travel of the bracket assembly so that the proper pressure is applied for a particular type and thickness of perforated material. A sensor, such as a photoelectric cell, may be provided to sense the presence of the continuous web in a high speed press and to switch off the press in case of a web break or jam up.

The presser roller of the present invention is, ideally, a hollow cylinder. The cylinder is mounted on a shaft connected to the pivoting bracket. The presser roller is free to move with the web and rotate about the shaft on roller bearings as it applies pressure to the perforated web of material traveling over the rotating cylinder of the press.

The cylindrical presser roller may include an annular groove around its external surface positioned away from the areas of perforations in the web. The groove in the presser roller allows extra material from a "baggy" web to run off into the groove, thus preventing the presser roller from wrinkling the web, which could result in a web break or jam up.

The presser roller of the present invention is attached to a web printing press to apply pressure to flatten the perforated material after the perforation process. Applying pressure to the perforated web flattens the ridges caused by the perforations in the material so that the continuous web can then be cut and stacked as individual sheets in high vertical stacks. Pressing the perforated material before cutting and stacking allows the web printing press to be run at a higher production speed and results in flattened material, which can be easily stacked and handled with automatic equipment.

BRIEF DESCRIPTION OF THE DRAWINGS

For a more complete understanding of the present invention and for further advantages thereof, reference is made to the following description of the preferred embodiment taken in conjunction with the accompanying drawings, in which the FIG. 1 is a cutaway isometric view of a presser roller apparatus of the present invention.

DESCRIPTION OF THE PREFERRED EMBODIMENT

Figure 1:
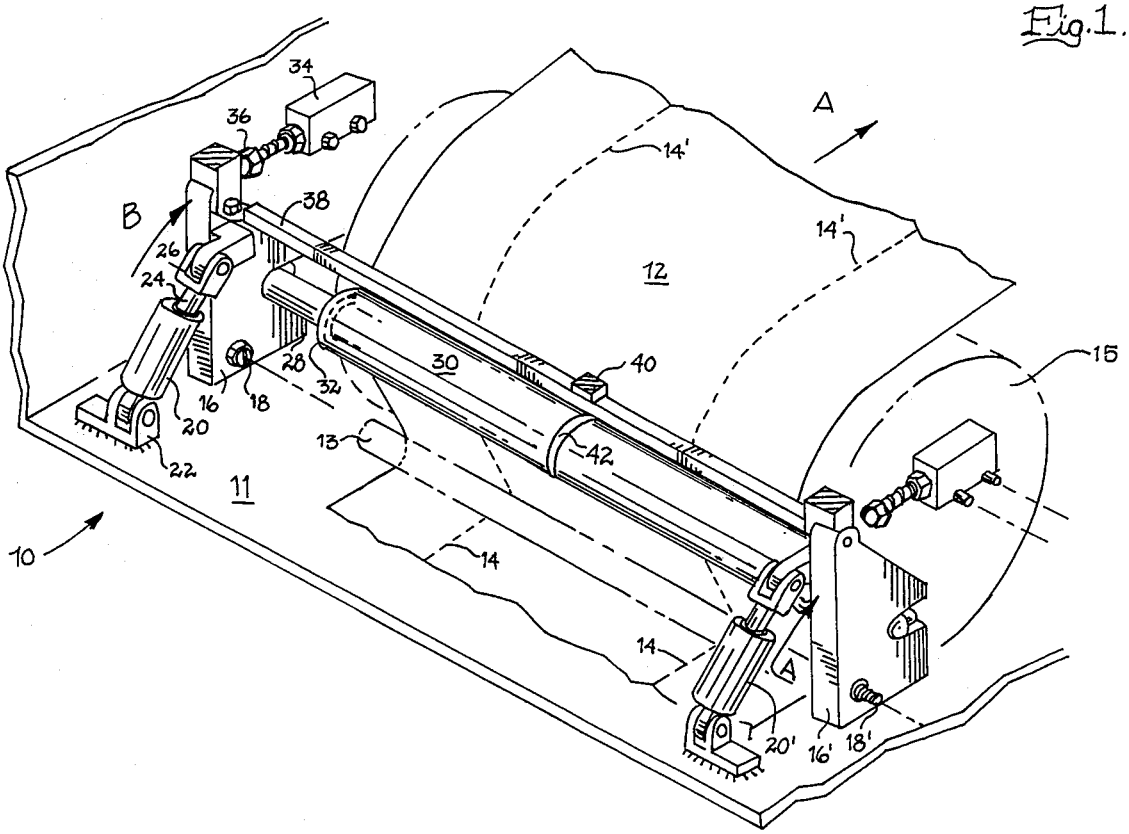
Figure 2:
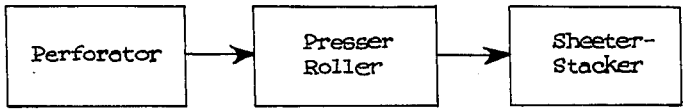
FIG. 2 is a schematic showing the placement of the presser roller shown in FIG. 1, between a perforator and sheeter-stacker of a web fed press, the arrows indicating the direction of web travel.

Referring to FIG. 1, a presser roller 10 of the present invention is shown mounted on a frame 11 of a web printing press. An idler/tension roller 13 and a rotating drive cylinder 15 of the web printing press are illustrated in phantom in the FIG. 1. Generally, these components 13 and 15 are near the end of the press, just before the web enters the sheeter-stacker (not shown). A continuous web of paper 12 travels through the web printing press in the direction of arrow A and is fed under the idler/tension roller 13 and over the drive cylinder 15. In the position shown in the drawing, the continuous web 12 has been perforated to form perforations 14 in a conventional, prior operation and may also have been printed and/or treated with silicone.

The function of the presser roller 10 is to press and flatten the perforations 14 (after flattening referred to as 14') as the continuous web 12 passes between the nip of the presser roller 10 and cylinder 15. The presser roller 10 includes a pair of brackets 16 and 16' which are pivotally mounted to the frame 11 by means of pivot pins 18 and 18'. The brackets 16 and 16' can be pivoted about pivot pins 18 and 18' by actuation of pneumatic cylinders 20 and 20'. Since the presser roller 10 illustrated in the drawing has identical components, such as the brackets 16 and 16', at opposite ends of the roller 10, for simplicity the remainder of the description refers only to the components at one, or the left, end of the roller 10.

The pneumatic cylinder 20 is mounted to the frame 11 by a bottom clevis 22. An actuator piston rod or arm 24 of the cylinder 20 is attached to the bracket 16 by means of a top clevis 26. A cylindrical non-rotating shaft 28 is mounted on and extends between the pair of brackets 16 and 16'. A hollow cylindrical roller 30 about is mounted to rotate about the shaft 28 by means of a roller bearing 32 (shown in dotted lines) at each end.

During operation of the presser roller 10, actuation of the pneumatic cylinders 20 and 20' causes the brackets 16 and 16' to pivot about the pins 18 an 18' in the direction of arrows B, thereby forcing the roller 30 against the web 12 with the desired pressure, sufficient to flatten the incoming perforations 14 against the drive cylinder 15 as the continuous web 12 moves over the cylinder 15 in the direction of arrow B. The already flattened perforations 14' then leave the nip of rollers 10 and 15 and head for the sheeter-stacker, wherein the web is cut or slit into sheets and stacked.

A stop block 34 is mounted on the frame 11. An adjustable stop 36 extends from the stop block 34 to limit the movement of the bracket 16 in the direction of arrow B. The adjustable stop 36 provides one means for adjusting the pressure applied by the roller 30 to the web 12 for various types and thicknesses of material comprising the web 12. A photosensor 40 may be mounted on a bar 38 extending between the brackets 16 and 16' for the purpose of sensing the presence of the web 12 and stopping the press if the web 12 breaks or becomes jammed. Of course, the photosensor could also be mounted in another manner in a position adjacent the presser roll 10. The roller 30 may include a groove 42 around its circumference which must be positioned away from the perforations 14 in the web 12. The purpose of the groove 42 is to allow excess material in a baggy web 12 to pass through the presser roller 10 without being wrinkled by the roller 30.

While a presser roller of full press width has been illustrated, it falls with the present invention to provide a presser roller of a shorter width which may be moved over the portion of the web that has been perforated. Also, while a means for forcing the presser roller toward the web has been shown as a pair of pneumatic cylinders, a bracket assembly could be devised wherein only one such pneumatic cylinder was used. Likewise, other type means such as a fluid cylinder, could be used for a similar purpose. While a photocell sensor was shown to prevent web jam ups, other type sensors could also be used, such as microswitches, etc., it being understood that the sensor is wired into the press controls system to stop the press should a jam up or web break occur.

Although the method and apparatus of the present invention has been illustrated and described with respect to a specific embodiment thereof, it is apparent that various changes and modifications may be suggested to one skilled in the art, and it is intended that the present invention encompass such changes and modifications as fall within the scope of the appended claims.

What is claimed is:

1. Apparatus for pressing flat perforations formed in a continuous web of paper moving through a web printing press, the web printing press having a frame on both sides of the web, means for perforating the web on the printing press to form perforations, at least one roller downstream of the means for perforating the web, and a sheeter-stacker downstream of the one roller, comprising a cylindrical presser roller extending substantially the full width across the web for engaging the web to flatten the perforations, said presser roller being supported to be rotated by friction with the web moving through the printing press, bracket means for rotatably mounting the two ends of said presser roller to the adjacent printing press frame to form a nip with the one roller, said nip formed by said presser roller and the one roller being positioned to receive the perforated web, and fluid cylinder means for controllably forcing said presser roller uniformly toward the one roller, whereby the perforations can be flattened to permit the web to be subsequently cut into sheets and vertically stacked by the sheeter-stacker without falling.

2. The apparatus as in claim 1, wherein the one roller is part of the sheeter-stacker.

3. The apparatus of claim 2, wherein said bracket means for rotatably mounting the presser roller comprises a pair of brackets, one mounted to each side of said frame, an elongated cylindrical shaft fixedly mounted on said brackets, said presser roller being a hollow cylinder, and a pair of bearings for mounting said presser roller on said shaft for rotation thereabout, one bearing being provided at each end of said shaft, said brackets being pivotably attached to said frame, said fluid cylinder means for applying a force comprises a pneumatic cylinder mounted between said frame and each of said brackets, an adjustable stop attached to said frame for limiting the motion of said presser roller, and a sensor mounted adjacent said presser roller for detecting a web break or jam up of the web of material traveling over the one roller and preventing press operation under such conditions, wherein actuation of said pneumatic cylinders urges said presser roller uniformly against the web of perforated material and said adjustable stop limits the travel of said presser roller toward the web.

4. The apparatus of claim 3, wherein said presser roller is grooved between its ends to prevent the formation of wrinkles in the web.

5. The apparatus of claim 1, wherein said bracket means for rotatably mounting said presser roller comprises a bracket assembly mounted on said frame, an elongated cylindrical shaft mounted on said bracket assembly, said presser roller being a hollow cylinder, and bearings for mounting said hollow cylinder on said shaft for rotation thereabout.

6. The apparatus of claim 5, wherein said bracket assembly is pivotably attached to said frame, and said fluid cylinder means for applying a force comprises at least one pneumatic cylinder mounted between said frame and said bracket assembly, wherein actuation of said pneumatic cylinder urges said presser roller against the web of perforated material.

7. The apparatus of claim 1, wherein said fluid cylinder means for applying a force comprises at least one pneumatic cylinder for applying force to press said presser roller against the perforated web, and an adjustable stop attached to said frame for limiting the motion of said presser roller toward the one roller, wherein said adjustable stop also limits the travel of said presser roller toward the web.

8. The apparatus of claim 1, further comprising a groove in and extending around the external circumferential surface of said presser roller to prevent wrinkles in the web.

9. The apparatus of claim 1, further comprising a sensor mounted adjacent said presser roller for detecting a web break or jam up of the web of material traveling over the one roller, and for preventing press operation under such conditions.

10. Apparatus as in claim 1, wherein said fluid cylinder means comprises at least one pneumatic cylinder for forcing said presser roller uniformly against said one roller.

11. Apparatus as in claim 1, wherein said fluid cylinder means comprises two pneumatic cylinders for forcing said presser roller against said one roller, each of said pneumatic cylinders forcing one of the ends of said presser roller toward the one roller.

* * * * *